US007198182B1

(12) United States Patent
Schulman

(10) Patent No.: US 7,198,182 B1
(45) Date of Patent: Apr. 3, 2007

(54) SELF ADVERTISING PAPER CLOTHES HANGER

(76) Inventor: Jared D Schulman, 56 Cobblers Mill Rd., Sandy Hook, CT (US) 06482

( * ) Notice: Subject to any disclaimer, the term of this patent is extended or adjusted under 35 U.S.C. 154(b) by 304 days.

(21) Appl. No.: 10/944,954

(22) Filed: Sep. 20, 2004

(51) Int. Cl.
*D41D 27/22* (2006.01)

(52) U.S. Cl. ..... 223/87

(58) Field of Classification Search ..... 223/85–98
See application file for complete search history.

(56) References Cited

U.S. PATENT DOCUMENTS

| | | | | |
|---|---|---|---|---|
| 1,510,915 | A | 10/1924 | Bartholdi | |
| 1,760,352 | A | 5/1930 | Feigelman | |
| 2,306,254 | A | 12/1942 | Quackenbush | |
| 2,617,565 | A | 11/1952 | Suydam | |
| RE25,841 | E * | 8/1965 | Gingher | 223/88 |
| 4,132,309 | A | 1/1979 | Shaylor | |
| 5,868,289 | A | 2/1999 | Lee | |
| 6,110,553 | A | 8/2000 | Grosskopf et al. | |
| 6,325,257 | B1 | 12/2001 | Micciche et al. | |
| 2004/0031825 | A1 * | 2/2004 | Roberts | 223/85 |
| 2005/0274752 | A1 * | 12/2005 | Goodman | 223/87 |

FOREIGN PATENT DOCUMENTS

| | | |
|---|---|---|
| JP | 2001061618 | 3/2001 |
| SE | 519026 | 12/2002 |
| WO | WO0651.960 | 5/1995 |

* cited by examiner

*Primary Examiner*—Shaun R. Hurley
(74) *Attorney, Agent, or Firm*—Michael I Kroll

(57) ABSTRACT

Apparatus for a one-piece, rigid paper hanger 16 with sufficient strength to hold a plurality of clothes having a printed color process with UV-coated inks to create two advertising areas 14 that are equal to the entire hanger surface area with detachable advertising cards 12 die cut therein, one on each side of the hanger and a locking mechanism 18 to hold multiple hangers of the same design together. The hanger 16 may be made from one piece of paper without a butterfly fold from paper of sufficient rigidity. In addition, the hook portion of the hanger 16 can have a coding system 22 comprised of bands of color substantially adjacent having a predetermined meaning to the coding system user.

10 Claims, 13 Drawing Sheets

SELF ADVERTISING PAPER CLOTHES HANGER

BACKGROUND OF THE INVENTION

1. Field of the Invention

The present invention relates generally to clothes hangers and, more specifically, to a one piece rigid paper hanger with sufficient strength to hold a plurality of clothes having printed color process with UV-coated inks to create two advertising areas that are equal to the entire hanger surface area with detachable advertising cards die cut therein, one on each side of said hanger and a locking mechanism to hold multiple hangers of the same design together.

The hanger of the present invention may be made from one piece of paper without a butterfly fold from paper of sufficient rigidity. In addition, the hook portion of the hanger can have a coding system comprised of bands of color substantially adjacent having a predetermined meaning to the coding system user.

This new and biodegradable paper clothes hanger is particularly adapted to convey advertising from an advertiser, such as a business or other entity desiring to advertise and to be provided free or below market cost to clothes hanger users such as dry cleaners, laundries and garment manufacturers.

The hanger of the present invention may be made of a single unfolded ply of paper using paper of sufficient rigidity.

2. Description of the Prior Art

There are other clothes hangers designed for the same purpose. Typical of these is U.S. Pat. No. 1,510,915 issued to Bartholdi on Oct. 7, 1924.

Another patent was issued to Feigelman on May 27, 1930 as U.S. Pat. No. 1,760,352. Yet another U.S. Pat. No. 2,306,254 was issued to Quackenbush on Dec. 22, 1943 and still yet another was issued on Nov. 11, 1952 to Suydam as U.S. Pat. No. 2,617,565.

Another patent was issued to Shaylor on Jan. 2, 1979 as U.S. Pat. No. 4,132,309. Yet another U.S. Pat. No. 5,868,289 was issued to Lee on Feb. 9, 1999. Another was issued to Grosskopf, et al. on Aug. 29, 2000 as U.S. Pat. No. 6,110, 553 and still yet another was issued on Dec. 4, 2001 to Micciche, et al. U.S. Pat. No. 6,325,257.

Another patent was issued to Swallert on Dec. 23, 2002 as U.S. Patent No. SE19026. Yet another U.S. Patent No. JP20011061618 was issued to Nakayama on Mar. 13, 2001. Another was issued to Holm on Dec. 5, 1995 as European. Patent No. 0 651 960 A1.

U.S. Pat. No. 1,510,915

Inventor: Amlo Bartholdi

Issued: Oct. 7, 1924

A clothes hanger formed from an integral sheet of material folded back upon itself, thereby providing a neck portion and supporting means forming a double thickness of material, one of which passes through the other, thereby providing an interlock.

U.S. Pat. No. 1,760,352

Inventor: Herman A. Feigelman

Issued: May 27, 1930

A garment hanger consisting of a blank of flexible stiff sheet material folded to form an elongated two-ply hanger bar and having a tongue extending from one ply of the hanger bar transversely of the line of fold and said tongue rebent and protruding through the part of said material forming the hanger bar and forming the suspender of the hanger.

U.S. Pat. No. 2,306,254

Inventor: Paul Henry Quackenbush

Issued: Dec. 22, 1942

A coat hanger of the type including sloping shoulder support bars and a trouser bar connecting said shoulder bars.

U.S. Pat. No. 2,617,565

Inventor: Bergen R. Suydam

Issued: Nov. 11, 1952

A foldable hanger forming blank comprising an elongated body section of sheet material having a relatively long slit extending lengthwise of the blank and substantially centered with respect thereto.

U.S. Pat. No. 4,132,309

Inventor: Harold Shaylor

Issued: Jan. 2, 1979

A combination label, hosiery package and hanger for hosiery comprises an elongated blank of paperboard or the like which is printed on one side with advertising and identification graphics and coated on the opposite side with a pressure sensitive adhesive. The elongated blank is divided by a pair of equally spaced, vertically oriented score lines into three primary panels of substantially equal size and shape to form a centrally located back panel and a pair of outboard side panels. The outboard side panels are further divided into pairs of subpanels by cut lines for accommodating the bulk of the packaged hose. For packaging the hose, the primary panels of the blank are folded along the vertically oriented scope lines into superposed relation about a pair of hosiery wherein the pressure sensitive adhesive coated side of the blank comes into contact with and adheres the hosiery into a matching pair. Meanwhile, the upper portion of the panels are provided with cutouts which coincide with one another in their superposed relation to provide a hook like opening for hanging the package on the pin element of a pin type display panel.

U.S. Pat. No. 5,868,289

Inventor: Sun Jae Lee

Issued: Feb. 9, 1999

A folded paperboard hanger including a slant plate part having two slant portions, a connecting plate part connecting end portions of the slant portions so as to make an approximate isosceles triangular formation, a hanging plate part formed as an one body together with the slant plate part for hanging the hanger, and a reinforcement plate part extended from one of the slant plate part and the connecting plate part. The reinforcement plate part is fixed by folding the reinforcement plate part so as to form an approximate right angle between the reinforcement plate part and the one of the slant plate part and the connecting plate part. An extending plate part is formed inside the connecting plate part and has a pair of hanging lugs. The extending plate part is folded by an angle of approximate 180 degrees such that the pair of hanging lugs are positioned at an opposite side of the hanging plate part with respect to the connecting plate part.

U.S. Pat. No. 6,110,553

Inventor: Glenn A. Grosskopf, et al.

Issued: Aug. 29, 2000

A label for displaying information regarding a container and suspending the container from a support and a method for forming the same. The label includes a base label having a lower surface. A base adhesive is disposed on the lower surface for affixing the label to the container. The label further includes a hanger having at least two interconnected legs defining an opening therebetween, each of the legs having a respective end. Each of the ends of the legs are secured to the base label. The hanger includes at least first and second superimposed layers. The layers are preferably formed of polymeric film. Preferably, the first layer has a tensile strength greater than the second layer and the second layer has a tear resistance greater than the first layer.

U.S. Pat. No. 6,325,257

Inventor: Carlo Micciche, et al.

Issued: Dec. 4, 2001

An improved triangular construction cloth hanger comprises a strip of a paperboard or plastic material, or of a laminate material, including two top wings symmetrically slanted to one another, and coupled to one another by a middle top portion and a bottom strip portion having a plurality of ridges made by forming through the strip body a plurality of longitudinal or slanted ribs and die cut portions and cut-outs, for providing the sheet material strip with a crowned construction.

Swedish Patent Number SE519026

Inventor: Sven A. Swallert

Issued: Dec. 23, 2002

The hanger together with the suspension hook is produced as a one piece stamped out body with the hook formed by a cut out open to one side in an upward direction part. The part is extended upwards through a section with a cut out. This section in turn is extended to the side which does not have a cut out with a section provided with a cut out which is identical to the first section.

Japanese Patent Number JP20011061618

Inventor: Seiji Nakayama

Issued: Mar. 13, 2001

To provide a hanger made of paper which has a hook part made of a paper with a high strength which can be surely hook on a hanger main body and wherein all parts are made of paper.

European Patent Application Number 0651960A1

Inventor: Stig Holm

Issued: May 10, 1995

A clothes hanger to be used but a few times, which is made as an integral piece of compressed wood fiber material and which comprises a body portion to support a garment and a hook portion for suspending the hanger. The clothes hanger is characterized in that the body portion and the hook portion are designed as an open shell such that the hanger is substantially completely nestable in a correspondingly shaped clothes hanger.

While these hangers may be suitable for the purposes for which they were designed, they would not be as suitable for the purposes of the present invention, as hereinafter described. A paper hanger having detachable advertising cards including bar coding and RFID tags formed within the body of the hanger, said hanger having a pivotal member formed within the body that when used in conjunction with other similar hangers form means for locking two or more such hangers together. The hook area providing means for receiving a plurality of colors forming means for color coding said hanger.

SUMMARY OF THE PRESENT INVENTION

The present invention discloses a one-piece, rigid paper hanger with sufficient strength to hold a plurality of clothes having a printed color process with UV-coated inks to create two advertising areas that are equal to the entire hanger surface area with detachable advertising cards die cut therein, one on each side of the hanger and a locking mechanism to hold multiple hangers of the same design together. The hanger may be made from one piece of paper without a butterfly fold from paper of sufficient rigidity. In addition, the hook portion of the hanger can have a coding system comprised of bands of color substantially adjacent having a predetermined meaning to the coding system user.

A primary object of the present invention is to provide a biodegradable one piece paper clothes hanger with sufficient strength and rigidity to hold a plurality of clothes types.

Another object of the present invention is to provide a biodegradable one piece paper clothes hanger that has printing rendered in a four color process with UV-coated inks to create two advertising areas that are equal to the entire hanger surface area with detachable advertising cards die cut therein.

Yet another object of the present invention is to provide a biodegradable one piece paper clothes hanger having detachable advertising cards die cut therein, one on each side of said hanger.

Still yet another object of the present invention is to provide a biodegradable one piece paper clothes hanger having a locking mechanism to hold multiple hangers of the same design together.

Another object of the present invention is to provide a biodegradable one piece paper clothes hanger wherein said paper is printed on and then folded and glued in a certain manner on the inside of said paper to create said hanger.

Yet another object of the present invention is to provide a biodegradable one piece paper clothes hanger wherein the advertising cards are detachable from the hanger body while maintaining structural integrity of said hanger. Also, the advertising cards or other hanger areas can contain a plurality of tracking mechanisms, such as bar codes or RFID tags thereon.

Another object of the present invention is to provide a hanger that includes at least two die cut areas creating a locking mechanism, said locking mechanism requiring no additional parts and made of paper comprising a movable tab pressed by the finger to lock said tab into the tab area of an adjacent clothes hanger.

Additional objects of the present invention will appear as the description proceeds.

The present invention overcomes the shortcomings of the prior art by providing a one piece rigid paper hanger with sufficient strength to hold a plurality of clothes having printed color process with UV-coated inks to create two advertising areas that are equal to the entire hanger surface area with detachable advertising cards die cut therein, one on each side of said hanger and a locking mechanism to hold multiple hangers of the same design together.

In addition, the hook portion of the hanger can have a coding system comprised of bands of color substantially adjacent having a predetermined meaning to the coding system user.

This new and biodegradable paper clothes hanger is particularly adapted to convey advertising from an advertiser, such as a business or other entity desiring to advertise and to be provided free or below market cost to cloths hanger users such as dry cleaners, laundries and garment manufacturers.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
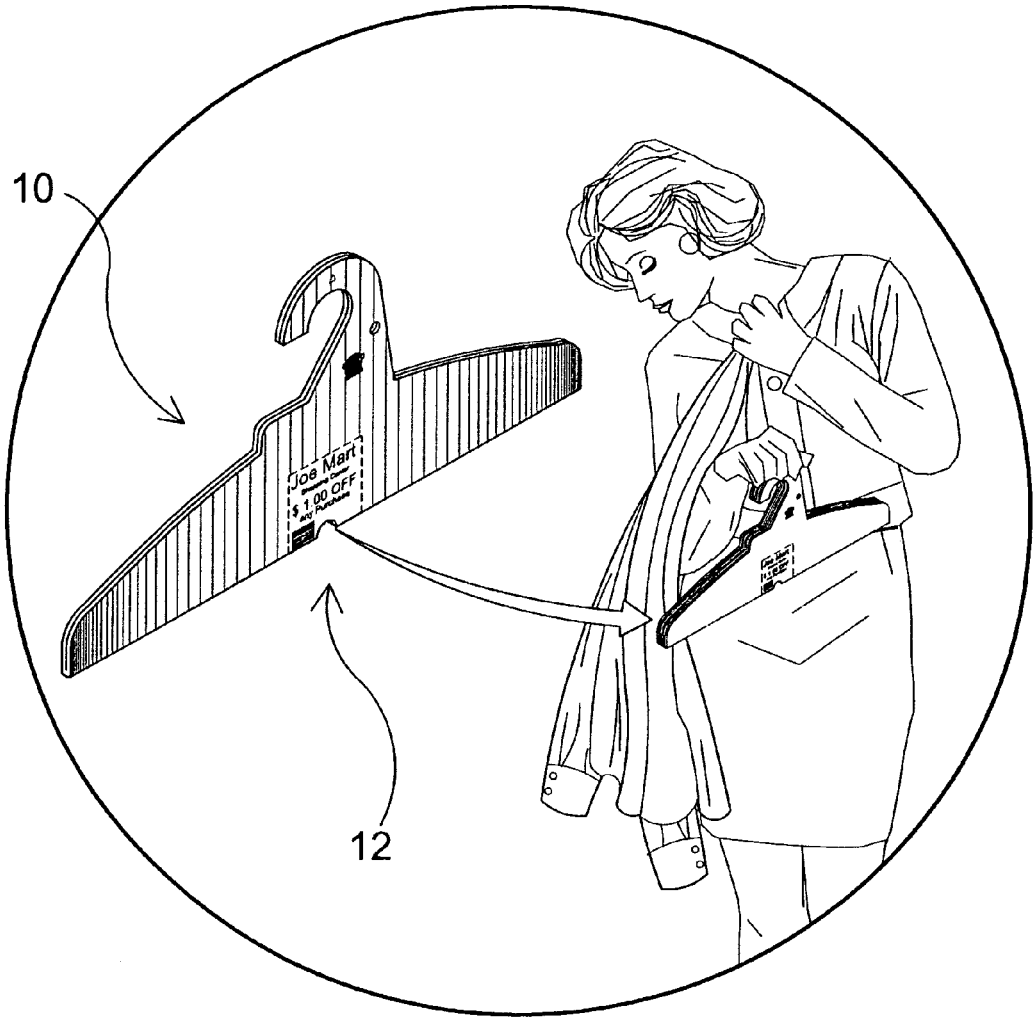
FIG. 1 is an illustrative view of the present invention in use.

With regard to reference numerals used, the following numbering is used throughout the drawings.

| | |
|---|---|
| 10 | present invention |
| 12 | cards |
| 14 | advertisement |
| 16 | hanger |
| 18 | locking mechanism |
| 20 | single fold paper |
| 22 | color code |
| 24 | twist tie hole |
| 26 | collar support |
| 28 | biodegradable paper |
| 30 | waterproof board |
| 32 | non-glued area |
| 34 | first half |
| 36 | second half |
| 38 | adhesive |
| 40 | pivot |
| 42 | second card |
| 44 | bar code |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a paper hanger having detachable advertising cards 12 formed within the body of the hanger. The hanger has a pivotal member formed within the body that when used in conjunction with other similar hangers form means for locking two or more such hangers together. The hook area providing means for receiving a plurality of colors forming means for color coding said hanger.

Figure 2:
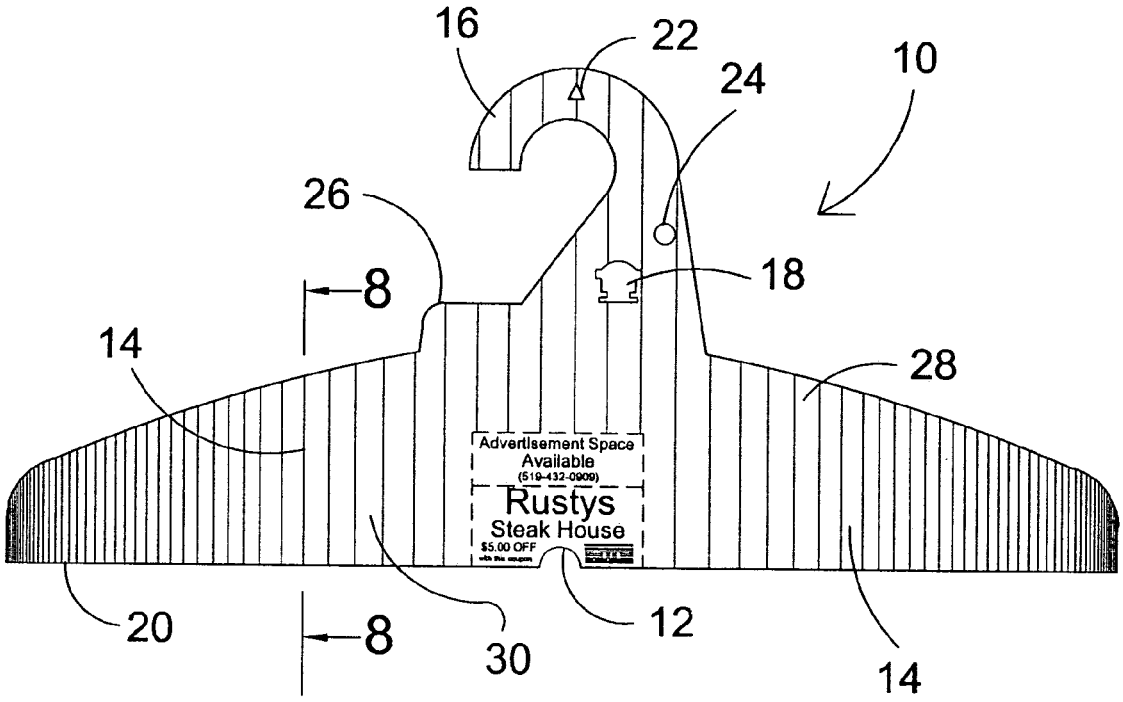
FIG. 2 is a frontal view of the present invention.

Turning to FIG. 2, shown therein is a frontal view of the present invention 10. Shown is the present invention 10 disclosing a hanger 20 made of one piece rigid paper 20, with a single fold at the bottom portion of the hanger with sufficient strength to hold a plurality of clothes having a printed color process with UV-coated inks to create two advertising areas 14 that are equal to the entire hanger surface area with detachable advertising cards 12 die cut therein, one on each side of the hanger and a locking mechanism 18 at the base of the hook of the hanger to hold multiple hangers of the same design together. Also shown are color code 22 at the top of the hook of the hanger, twist tie hole 24, collar support 26 at the base of the hook of the hanger, biodegradable paper 28 and waterproof board 30.

Figure 3:
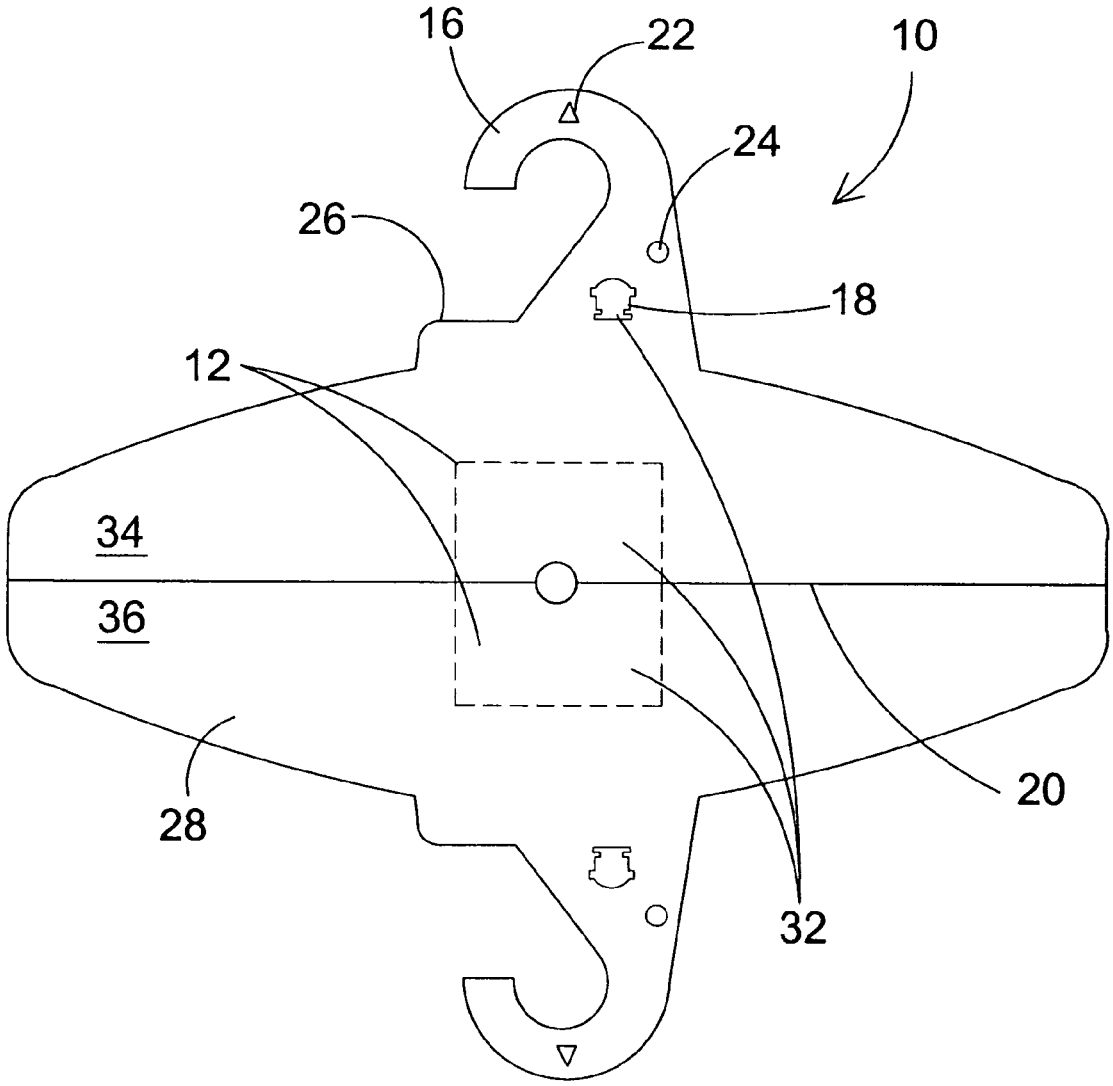
FIG. 3 is an inside fold planar view of the present invention.

Turning to FIG. 3, shown therein is an inside fold planar view of the present invention 10. Shown is the present invention 10 disclosing a one piece 20, rigid paper hanger 16 that is printed on and then folded and glued in a certain manner on the inside of the design to create the hanger 16. The detachable advertisement cards 12 and locking mechanism 18 are not glued. Also shown are color code 22, twist tie hole 24, collar support 26, biodegradable paper 28 and waterproof board 30. Also shown are the non-glued area 32 and first 34 and second 36 halves.

Figure 4:
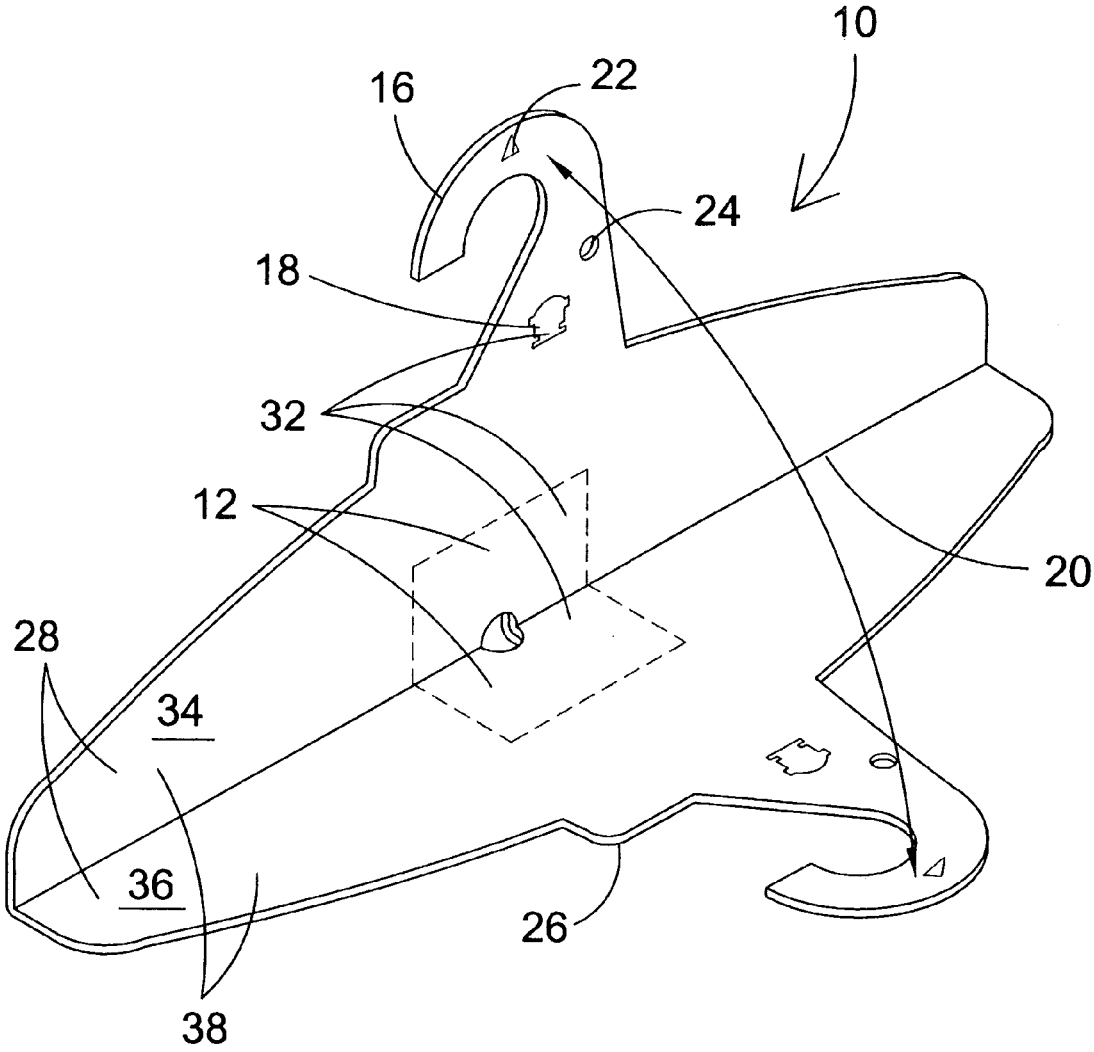
FIG. 4 is an inside fold perspective view of the gluing and folding of the present invention.

Turning to FIG. 4, shown therein is an inside fold perspective view of the gluing and folding of the present invention 10. Shown is the present invention 10 disclosing a one piece 20, rigid paper hanger 16 that is printed on and then folded and glued in a certain manner on the inside of the design to create the hanger. At least two die cut areas creating a locking mechanism 18 comprising a movable tab pressed by the user's finger to lock the tab into the tab area of an adjacent hanger. Also shown are adhesive 38 along with other previously disclosed elements.

Figure 5:
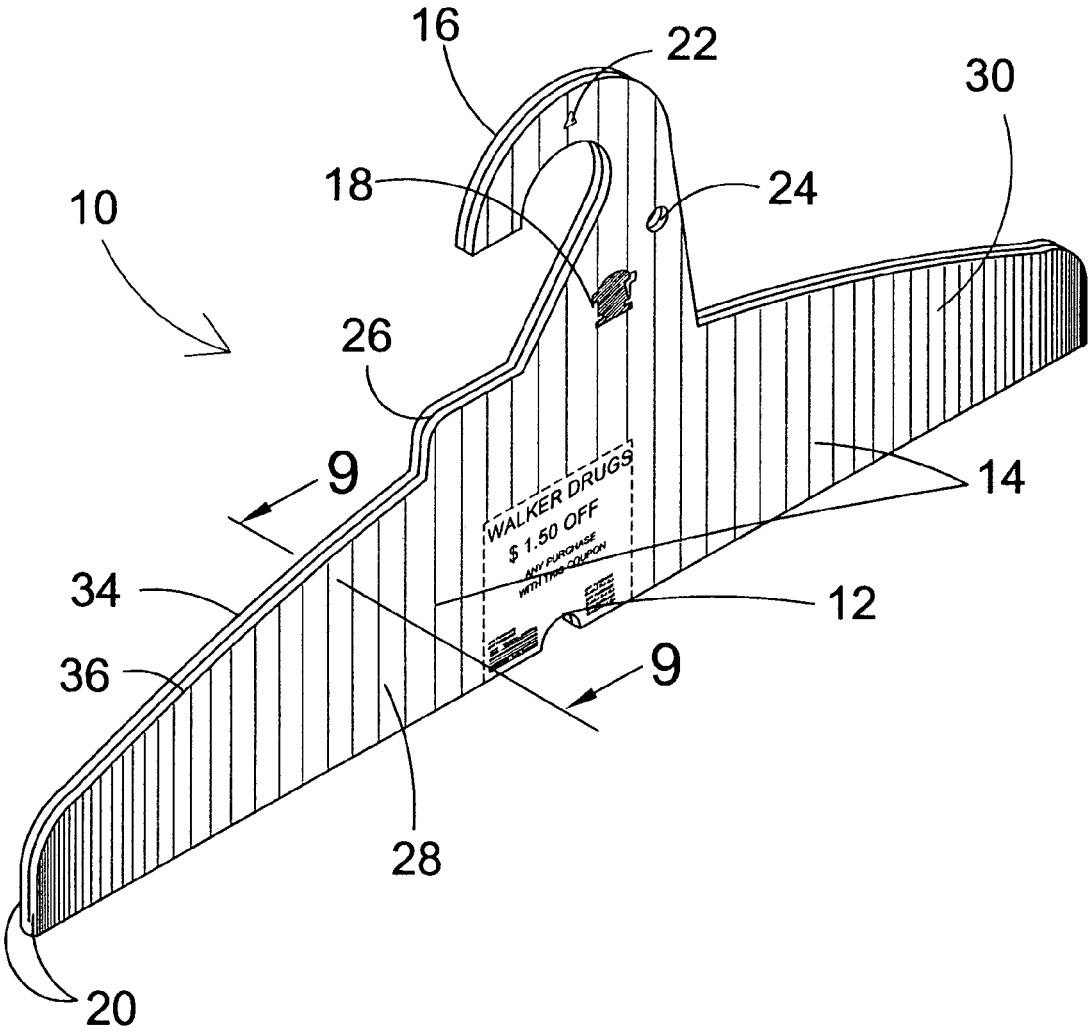
FIG. 5 is a perspective view of the present invention in its formed hanger shape.

Turning to FIG. 5, shown therein is a perspective view of the present invention 10 in its formed hanger shape. Shown is the present invention 10 disclosing a paper hanger 16 having detachable advertising cards 12 formed within the body of the hanger, the hanger having a pivotal member formed within the body that when used in conjunction with other similar hangers form means for locking 18 two or more such hangers together. The hook area provides means for receiving a plurality of colors forming means for color coding 22 the hanger 16 for a plurality of industry specific uses. Other previously disclosed elements are also shown.

Figure 6:
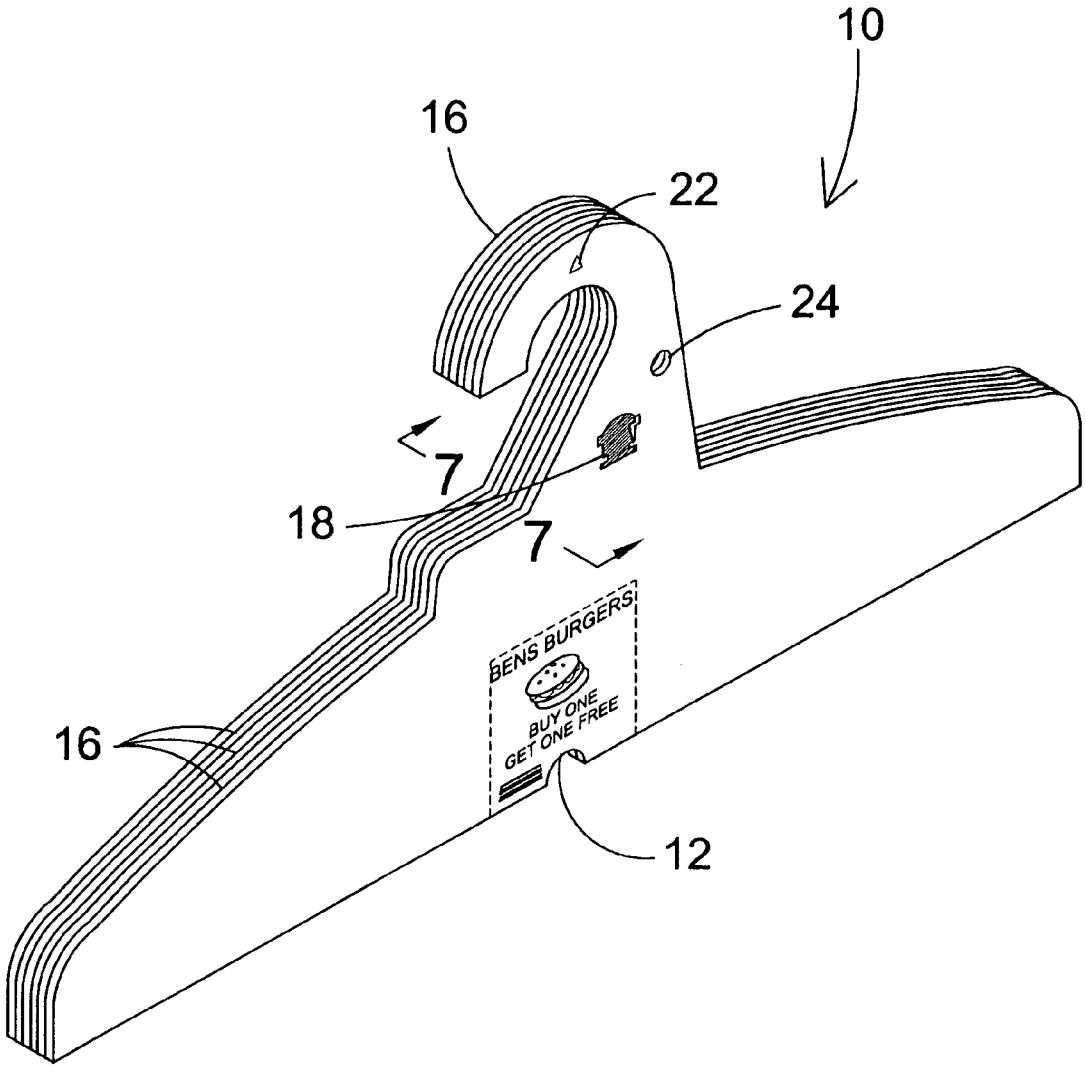
FIG. 6 is a perspective view of the present invention having a plurality of hangers locked together.

Turning to FIG. 6, shown therein is a perspective view of the present invention 10 having a plurality of hangers 16 locked together. Shown is the present invention 10 disclosing a paper hanger 16 having detachable advertising cards 12 formed within the body of the hanger, the hanger having a pivotal member 18 formed within the body that when used in conjunction with other similar hangers form means for locking two or more such hangers together. The hook area provides means for receiving a plurality of colors forming means for color coding 22 the hanger 16. The twist tie hole 24 is also shown.

Figure 7:
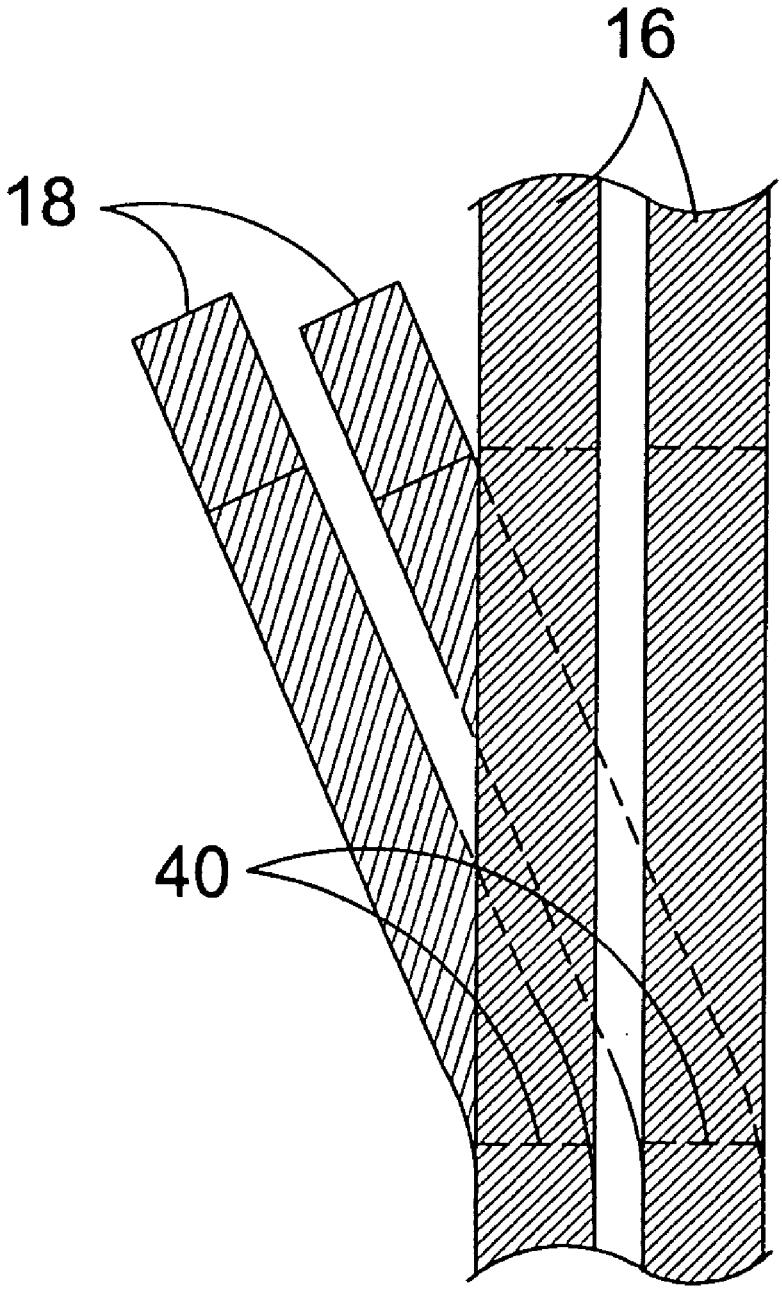
FIG. 7 is a cross sectional view of the locking mechanism of the present invention

Turning to FIG. 7, shown therein is a cross sectional view of the locking mechanism of the present invention. Shown is the present invention disclosing a paper hanger 16 having detachable advertising cards formed within the body of the hanger, the hanger having a pivotal member 18 with pivots 40 formed within the body that when used in conjunction with other similar hangers form means for locking two or more such hangers together. The hook area provides means for receiving a plurality of colors forming means for color coding said hanger.

Figure 8:
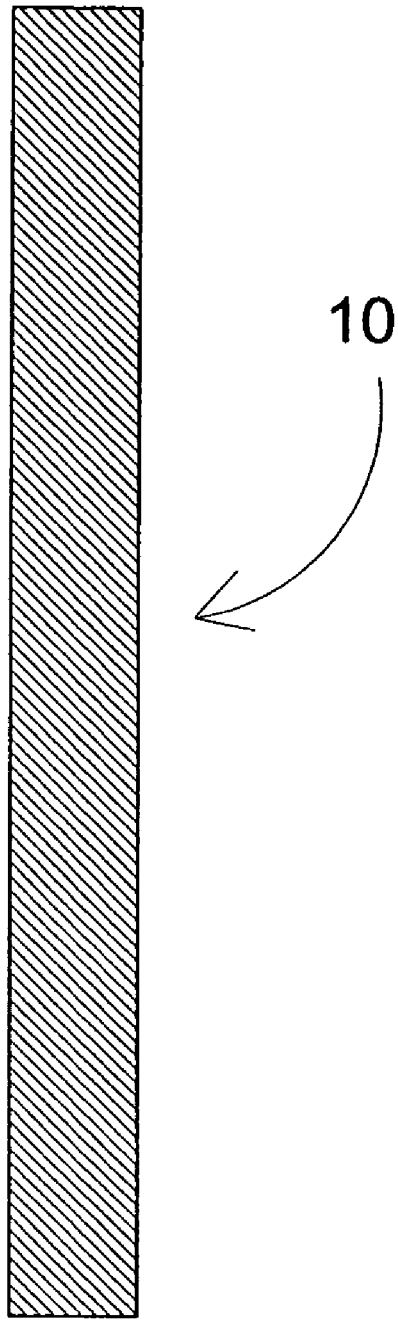
FIG. 8 is a sectional view of the present invention taken from FIG. 2.

Turning to FIG. 8, shown therein is a sectional view of the present invention taken from FIG. 2. Shown is the present invention 10 disclosing a paper hanger that may be made out of one piece of paper without a butterfly fold from paper of sufficient rigidity.

Figure 9:
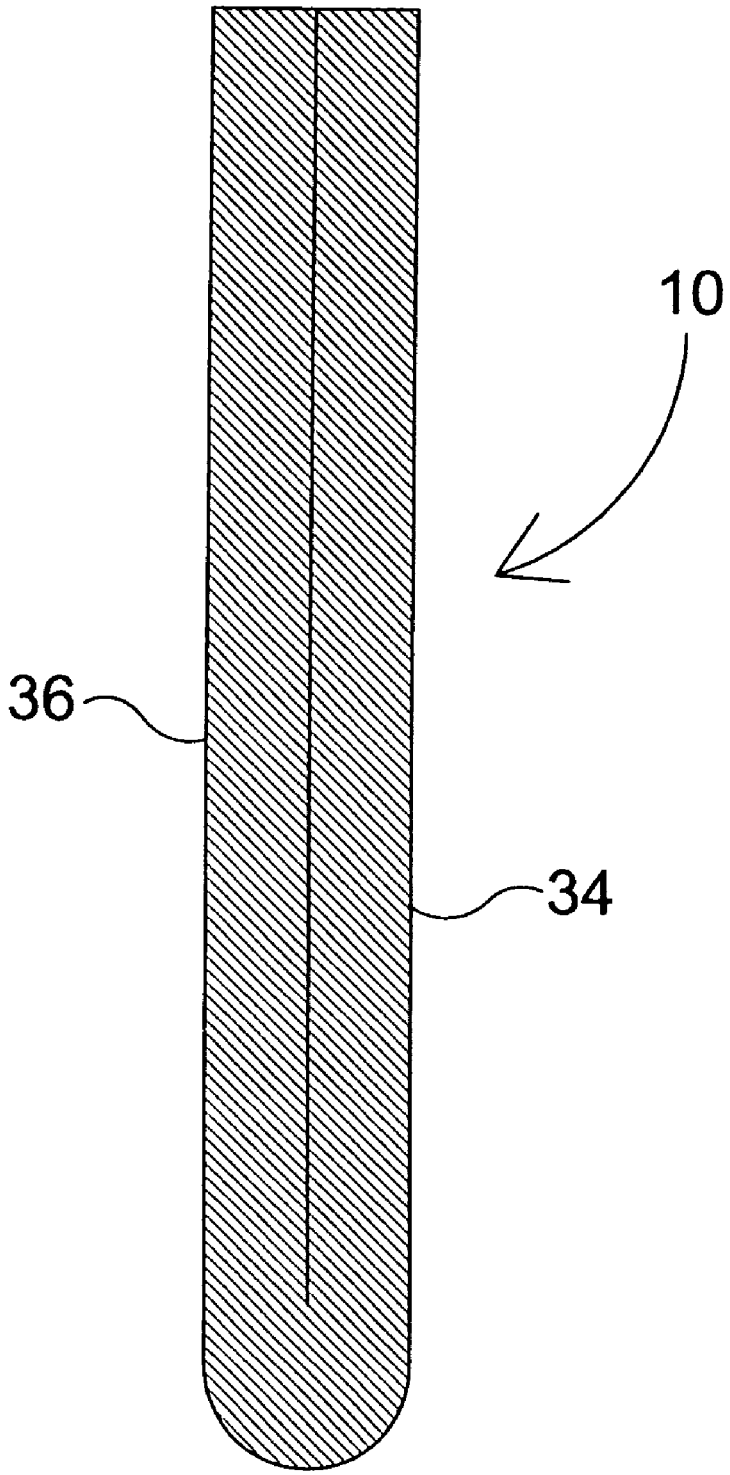
FIG. 9 is a cross sectional view of the present invention taken from FIG. 5.

Turning to FIG. 9, shown therein is a cross sectional view of the present invention 10 taken from FIG. 5. Shown is the present invention 10 disclosing a paper hanger having detachable advertising cards formed within the body of the hanger, the hanger having a pivotal member formed within the body that when used in conjunction with other similar hangers form means for locking two or more such hangers together. The hook area provides means for receiving a plurality of colors forming means for color coding the hanger. Also shown are first 34 and second 36 halves.

Figure 10:
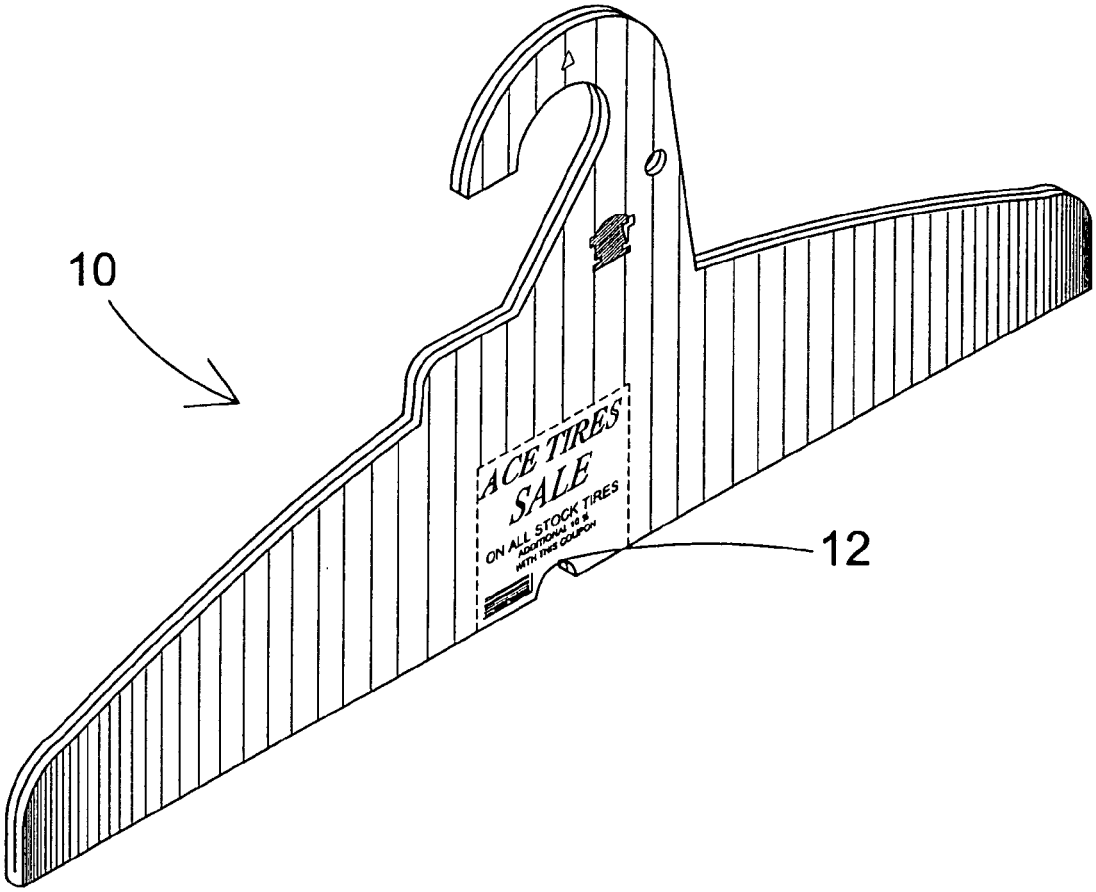
FIG. 10 is a perspective view of the present invention having a detachable advertising card.

Turning to FIG. 10, shown therein is a perspective view of the present invention 10 having a detachable advertising card 12. Shown is the present invention 10 disclosing a paper hanger having detachable advertising cards 12 formed within the body of the hanger, the hanger having a pivotal member formed within the body that when used in conjunction with other similar hangers form means for locking two or more such hangers together. The hook area provides means for receiving a plurality of colors forming means for color coding the hanger.

Figure 11:
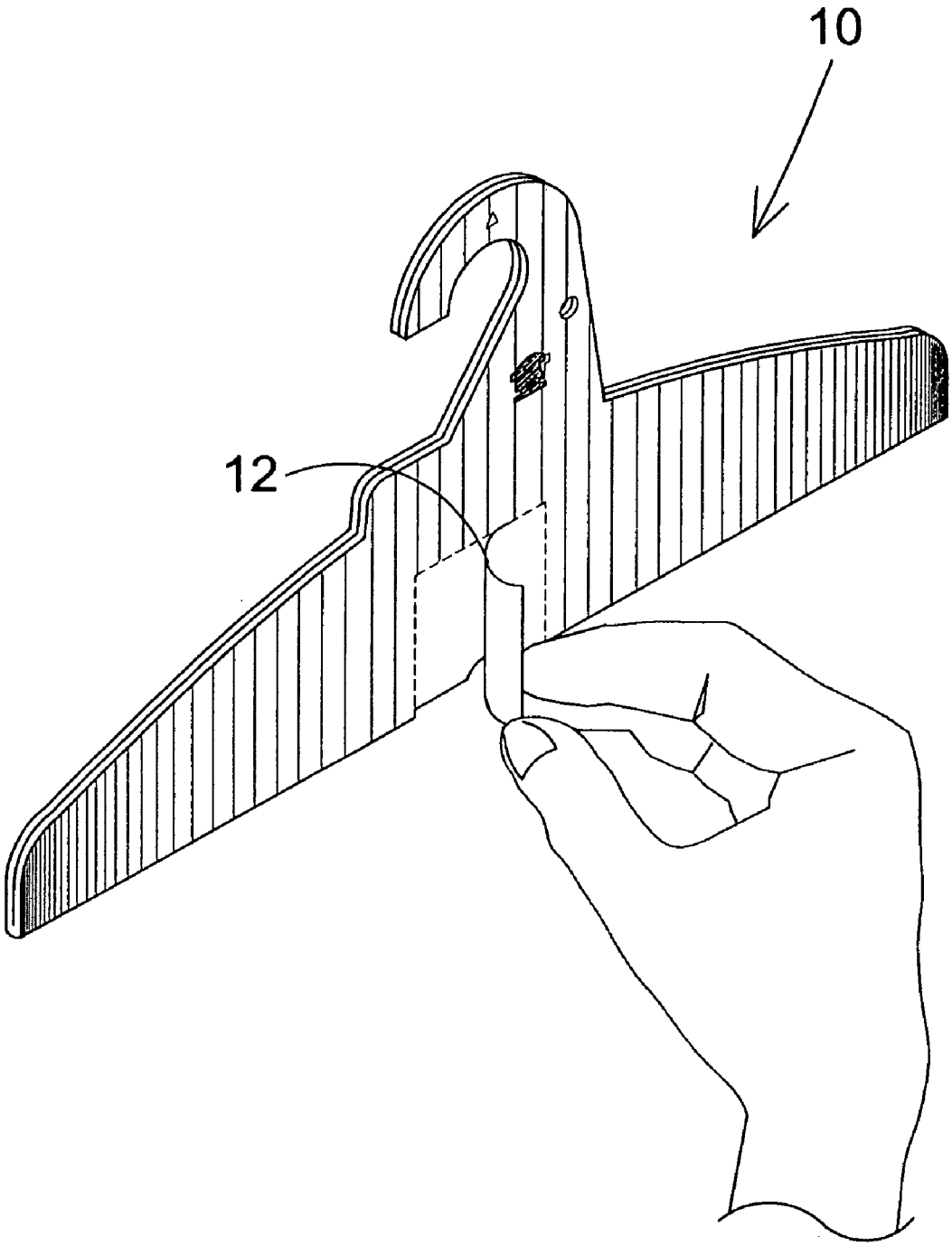
FIG. 11 a perspective view of the present invention having a detachable advertising card shown partially removed.

Turning to FIG. 11, shown therein a perspective view of the present invention 10 having a detachable advertising card 12 shown partially removed. Shown is the present invention 10 disclosing a paper hanger having detachable advertising cards 12 formed within the body of the hanger, the hanger having a pivotal member formed within the body that when used in conjunction with other similar hangers form means for locking two or more such hangers together. The hook area providing means for receiving a plurality of colors forming means for color coding the hanger.

Figure 12:
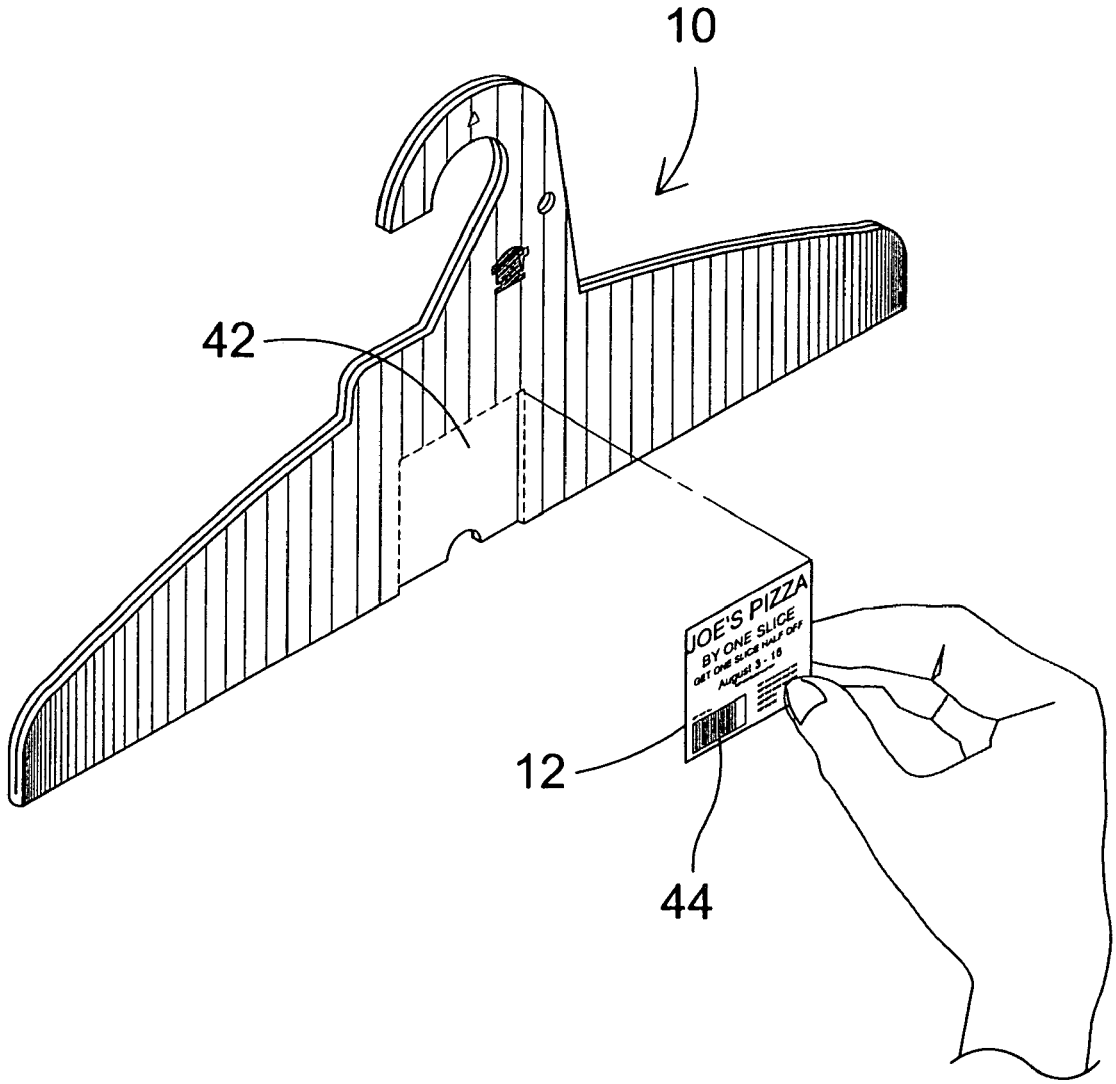
FIG. 12 is a perspective view of the present invention having a detachable advertising card shown fully removed.

Turning to FIG. 12, shown therein is a perspective view of the present invention 10 having a detachable advertising card 12 shown fully removed. Shown is the present invention 10 disclosing a paper hanger having detachable advertising cards 12 formed within the body of the hanger, the hanger having a pivotal member formed within the body that when used in conjunction with other similar hangers form means for locking two or more such hangers together. The hook area providing means for receiving a plurality of colors forming means for color coding the hanger. Also shown is a second detachable card 42 and bar code or RFID tagging 44.

Figure 13:
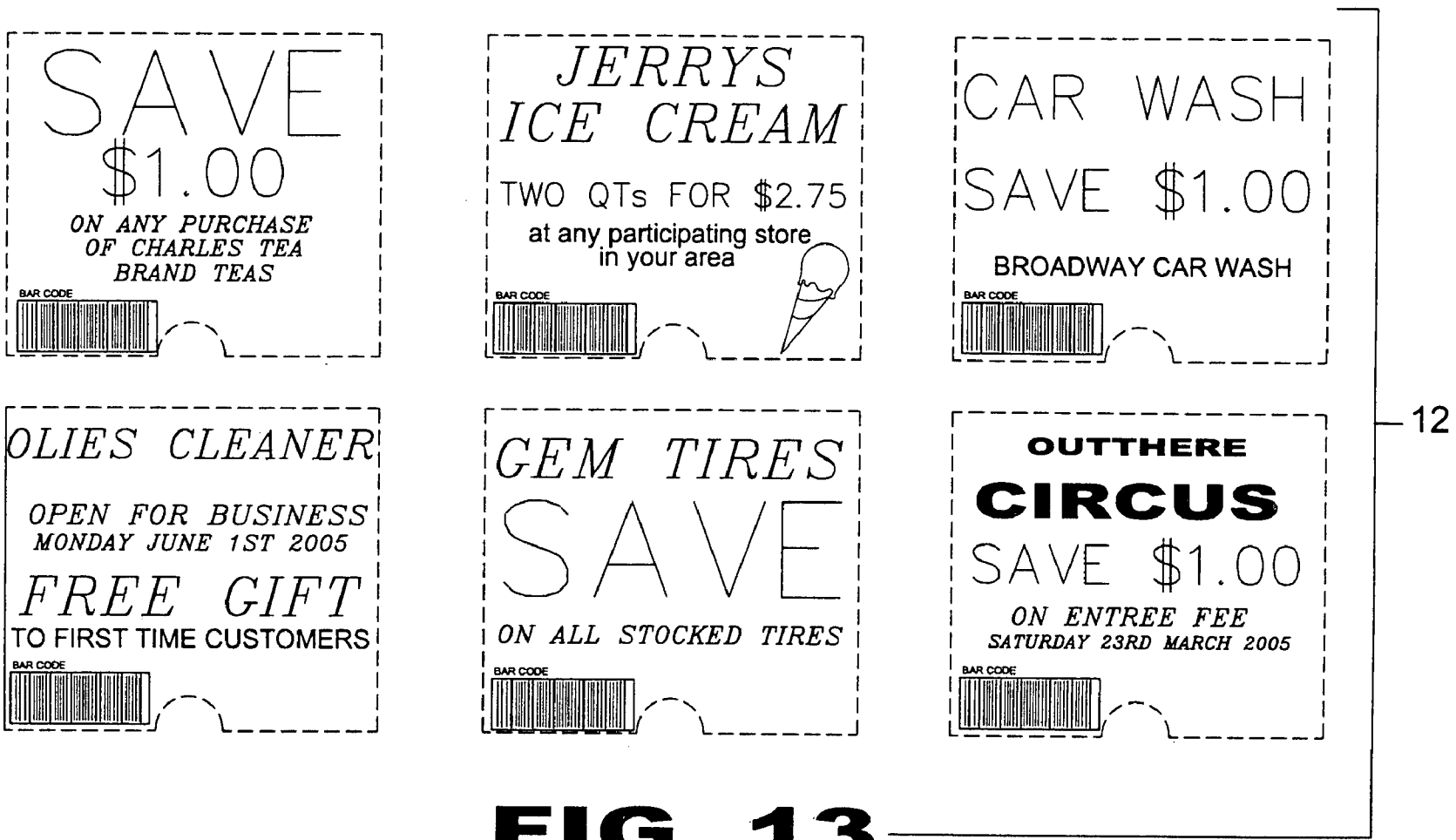
FIG. 13 is a view of possible advertising cards and coupons of the present invention.

Turning to FIG. 13, shown therein is a view of possible advertising cards 12 and coupons of the present invention. Shown is the present invention disclosing a paper hanger having detachable advertising cards 12 formed within the body of the hanger.

I claim:

1. An apparatus for hanging clothes thereon, comprising:

a hanger having first and second ends, top and bottom portions, and first and second halves, said first and second halves each having an inner and outer surface to permit clothes to be hung on the hanger;

a hook being disposed on said top portion intermediate said first and second ends of said hanger, said hook having a top part and a base part to permit the hook to be attached to a hanging bar; and, at least one detachable card being disposed on said outer surface of one of said first and second halves of said hanger, wherein said card comprises written communications thereon for conveying a message to a user, a collar support area being disposed on said hanger underneath and adjacent said base part of said hook to permit a collar of the clothes to be supported, wherein said hanger is made of one piece of rigid paper, wherein said piece of rigid paper is folded from said first to second end along said bottom portion of said hanger to permit the hanger to be formed, further comprising means for locking a plurality of said hangers together whereby more than one hanger can be joined together in a side-by-side relationship, further comprising means for color coding said hangers whereby the hangers can be identified by a user, wherein said means for locking comprises:

a pivoting member being disposed on said hanger; and, wherein said pivoting member is formed in said first and second halves of said hanger by having said rigid paper be cut-out so that only a pivoting portion remains uncut so that more than one of said hangers can be joined together in a side-by-side relationship by interlocking said pivoting members of said hangers.

2. The apparatus of claim 1, wherein said pivoting member is disposed in said base part of said hook of said hanger.

3. The apparatus of claim 2, wherein said means for color coding said hanger comprises a color being disposed on said hanger to permit the hangers to be identified by a user.

4. The apparatus of claim 3, wherein said color is disposed on said top part of said hook.

5. The apparatus of claim 4, further comprising a twist tie hole being disposed in said hook of said hanger to permit a plurality of hangers to be joined together by a twist tie.

6. The apparatus of claim 5, wherein said first and second halves of said hanger are joined together by adhesive being disposed on said inner surface of said first and second halves of said hanger.

7. The apparatus of claim 6, further comprising a written communication being disposed on said outer surfaces of said first and second halves of said hanger for conveying a message to a user.

8. The apparatus of claim 7, further comprising a plurality of detachable cards being disposed on said outer surface of one of said first and second halves of said hanger, wherein said card comprises written communications thereon for conveying a message to a user.

9. The apparatus of claim 8, wherein said hanger is made of biodegradable paper.

10. The apparatus of claim 9, wherein said hanger is made of waterproof paper.

* * * * *